US008911138B2

(12) United States Patent
Cook et al.

(10) Patent No.: US 8,911,138 B2
(45) Date of Patent: Dec. 16, 2014

(54) FLUID DISPENSING SYSTEM AND METHOD FOR CONCRETE MIXER

(75) Inventors: Robert E. Cook, Wakefield, MA (US); James Klauke, Miamisburg, OH (US); Eric P. Koehler, West Chester, OH (US); Reynold Ramnarine, Wellington, FL (US); Mark F. Roberts, North Andover, MA (US)

(73) Assignee: Verifi LLC, West Chester, OH (US)

( * ) Notice: Subject to any disclaimer, the term of this patent is extended or adjusted under 35 U.S.C. 154(b) by 930 days.

(21) Appl. No.: 13/076,687

(22) Filed: Mar. 31, 2011

(65) Prior Publication Data

US 2012/0250446 A1 Oct. 4, 2012

(51) Int. Cl.
*B28C 7/12* (2006.01)
*B28C 5/42* (2006.01)
*B01F 9/02* (2006.01)

(52) U.S. Cl.
CPC ..... *B28C 5/422* (2013.01); *B28C 5/4231* (2013.01); *B01F 9/025* (2013.01)
USPC ..... 366/19; 366/34

(58) Field of Classification Search
CPC .... B28C 5/422; B28C 5/4231; B28C 5/4234; B28C 5/4237; B28C 7/126; B28C 7/128; B01F 9/025
USPC ..... 366/6, 19, 30, 34, 40, 53–63
See application file for complete search history.

(56) References Cited

U.S. PATENT DOCUMENTS 4,008,093 A 2/1977 Kitsuda et al.
4,356,723 A 11/1982 Fay
4,478,514 A * 10/1984 Hudelmaier ..... 366/2
4,544,275 A * 10/1985 Hudelmaier ..... 366/30
4,786,179 A * 11/1988 Kaminski ..... 366/2
4,789,244 A * 12/1988 Dunton et al. ..... 366/12
4,792,234 A * 12/1988 Doherty ..... 366/14
5,653,533 A * 8/1997 Green ..... 366/19
5,713,663 A 2/1998 Zandberg et al.
5,895,116 A 4/1999 Kreinheder et al.
6,042,258 A * 3/2000 Hines et al. ..... 366/8
6,042,259 A * 3/2000 Hines et al. ..... 366/17
6,224,250 B1 5/2001 Kreinheder et al.
6,484,079 B2 11/2002 Buckelew et al.
6,611,755 B1 8/2003 Coffee et al.
7,246,009 B2 7/2007 Hamblen et al.
7,386,368 B2 6/2008 Andersen et al.

(Continued)

FOREIGN PATENT DOCUMENTS

GB 879199 * 10/1961
WO 2010111204 9/2010

*Primary Examiner* — Charles Cooley
(74) *Attorney, Agent, or Firm* — Craig K. Leon

(57) ABSTRACT

System and method for dispensing liquids into concrete mixer drums, particularly suitable for use on concrete mix trucks, involve use of liquid admixtures nozzle that is separate from water conduit and water nozzle, the admixtures nozzle being aimed and focused to spray through drum opening with dispersion pattern substantially within air/concrete interface defined by minimal volume concrete contained within the drum; and the water conduit or nozzle having a dispersion pattern preferably whereby wash water hits a portion of the inner drum wall and a portion of the air/concrete interface defined by a maximum amount of concrete contained within the drum. In preferred embodiments, a check valve assembly is used to connect separate admixture and water lines, so that both admixture and water nozzles can be used simultaneously during purging operation.

7 Claims, 4 Drawing Sheets

(56) References Cited

U.S. PATENT DOCUMENTS

| | | | | |
|---|---|---|---|---|
| 8,118,473 | B2 * | 2/2012 | Compton et al. | 366/17 |
| 8,727,604 | B2 * | 5/2014 | Compton et al. | 366/61 |
| 8,746,954 | B2 * | 6/2014 | Cooley et al. | 366/54 |
| 8,764,272 | B2 * | 7/2014 | Hazrati et al. | 366/2 |
| 2005/0141338 | A1 | 6/2005 | Jarvinen et al. | |
| 2005/0159843 | A1 * | 7/2005 | Oberg et al. | 700/265 |
| 2007/0185636 | A1 | 8/2007 | Cooley et al. | |
| 2008/0316856 | A1 | 12/2008 | Cooley et al. | |
| 2009/0037026 | A1 | 2/2009 | Sostaric et al. | |
| 2010/0188925 | A1 * | 7/2010 | Huber et al. | 366/30 |
| 2011/0029134 | A1 | 2/2011 | Hazrati et al. | |
| 2012/0250446 | A1 * | 10/2012 | Cook et al. | 366/6 |

* cited by examiner

FLUID DISPENSING SYSTEM AND METHOD FOR CONCRETE MIXER

FIELD OF THE INVENTION

The present invention relates to manufacturing of concrete, and more particularly to a system and method for dispensing liquid chemical admixtures and water into a concrete mixer drum.

BACKGROUND OF THE INVENTION

Concrete is made from cement, water, and aggregates, and optionally one or more chemical admixtures. Such chemical admixtures are added to improve various properties of the concrete, such as its rheology (e.g., slump, fluidity), initiation of setting, rate of hardening, strength, resistance to freezing and thawing, shrinkage, and other properties.

In most cases, chemical admixtures are added at the concrete plant at the time of batching. In a "dry batch" plant, the cement, water, aggregates, and chemical admixtures are added from separate compartments (e.g. bins or silos) into the rotatable drum of the ready mix truck, and the ingredients are mixed together. In a "wet batch" or "central mix" plant, all ingredients are combined and fully mixed in a fixed-location mixer, then dumped into the rotatable drum on the truck. A "shrink mix" plant is similar to a "wet batch" or "central mix" plant, with the exception that the ingredients are only partially mixed in the fixed-location mixer, then mixing is completed within the truck mixer.

In a typical dry batch process, the "head water" is first added, followed by the aggregate and cement, and then followed by the "tail water." The chemical admixture is usually added with the head or tail water. In this way, it is diluted and enough water is present to rinse all chemical admixtures into the mixing drum. In addition, chemical admixture may be added directly on the aggregate as the aggregate is being conveyed to the drum, thus ensuring that all chemical admixtures enter into the drum of the ready mix truck.

The drum of a ready mix truck is an oblong shape with an opening at one end. It is mounted at an angle such that the opening is at the top. Mixing blades or fins are mounted in a helical pattern inside the drum. When the drum is rotated in one direction, the mixing blades push the concrete to the lower end of the drum and cause mixing. When the drum is rotated in the other direction, the mixing blades push the concrete up to and out of the opening. The drum can only be filled partially full with fluid, plastic concrete, because otherwise the concrete will tend to splash out from the truck beyond a certain point.

After batching, the truck moves away from the loading area of the plant and, in the case of dry-batch or shrink mix concrete, completes the initial mixing of concrete, before departing for the jobsite. Frequently, it is desirable to add additional fluid (water or chemical admixture) after the concrete is batched and initially mixed, including up to the time of final discharge at the jobsite. This may be done because some chemical admixtures perform better when added after batching. It is sometimes necessary to add additional fluids to compensate for variations in batching of all ingredients (e.g. too little water added at batching) or changes in concrete properties over time (e.g. loss of flowability and other rheological properties).

It is known to control the "slump" of concrete in ready-mix delivery trucks by using sensors to monitor the energy required for rotating the mixing drum, such as by monitoring the torque applied to the drum by measuring hydraulic pressure and to adjust fluidity by adding fluid into the mixing drum. Fluid dispensing systems are disclosed in U.S. Pat. Nos. 4,008,093, 5,713,663, and U.S. patent application Ser. Nos. 10/599,130, 11/764,832, and 11/834,002, as examples.

Concrete trucks are commonly equipped with water tanks connected by a hose line directed into the drum opening. In this manner, water can be dispensed into the drum under air pressure in the tank or by pump. Such tank dispensing devices are disclosed in U.S. Pat. No. 4,544,275, U.S. Pat. No. 7,842,096 and U.S. patent application Ser. No. 11/955,737, for example.

It is less common for chemical admixture tanks to be mounted on trucks. When such admixture tanks are present, however, the tank is typically connected to the same hose line used to discharge water into the drum. The chemical admixture may be dispensed into the water line under air pressure or by tank to the pump. This is exemplified in U.S. Pat. No. 7,730,903. The present inventors believe that the use of water dispensing equipment is not ideal for the dispensing of liquid chemical admixtures into the concrete mixer drum.

Hence, it is an objective of the present inventors to provide a novel apparatus and method for dispensing both water and liquid chemical admixtures into concrete mixing drums.

SUMMARY OF THE INVENTION

The present invention provides a novel system and method for dispensing liquid chemical admixtures and water into a concrete mixer drum, and is useful for mixers in plant installations and especially useful in concrete ready-mix delivery trucks.

An exemplary apparatus or system of the present invention for injecting liquids into a rotatable concrete mixer drum, comprises: a concrete mixer drum which is rotatably mounted to permit rotation about a rotation axis inclined at an orientation of 5-40 degrees relative to level ground and which has an oblong drum body with a inner circumferential wall connecting opposed first and second ends for defining a cavity within which to contain a fluid concrete; one of the two opposed ends of the oblong drum body having an opening to permit loading and unloading of concrete, and the other end being conformed to contain a nominal maximum concrete capacity such that a fluid concrete contained in the drum in the amount of 10%-30% of the nominal maximum concrete capacity presents an air/concrete interface having a first exposed surface area, designated herein as "ESA1," and such that a fluid concrete contained in the drum in the amount of 70%-100% of the nominal maximum concrete capacity presents an air/concrete interface having exposed surface area, designated herein as "ESA2," whereby ESA2 is greater than ESA1; a first conduit connected to a water source for introducing water into the mixer drum through the opening, the first conduit being aimed and mounted with respect to the drum opening, whereby 0%-100% of the water introduced through the first conduit into the drum would hit the air-concrete interface within ESA2; and a nozzle connected to a liquid chemical admixture source for introducing liquid chemical admixture into the drum through the opening, the nozzle being aimed and mounted with respect to the drum opening and having a nozzle aperture which is focused such that 75%-100% of the chemical admixture sprayed through the liquid chemical admixture nozzle into the drum would hit the air-concrete interface within ESA1.

An exemplary method of the present invention comprises providing the above-described apparatus on a concrete mixer drum. In preferred embodiments, the liquid chemical admixture nozzle is connected switchably to said pumped or pressurized water source, so that the liquid chemical admixture nozzle can be purged with water. The purging can be performed, for example, at the same time that water is introduced through the conduit into the mixer drum.

The present invention is believed to provide immense improvements over prior art practice, wherein existing nozzles were originally intended to dispense water, and as such are designed to dispense large volumes of fluid quickly and rather indiscriminately onto the inner sides of the drum.

The present invention allows the liquid chemical admixture to be dispensed most effectively and safely, and employs a separate admixture nozzle, which can be purged of cement dust that builds up over time during initial batching/mixing of the concrete and otherwise tends to clog the nozzle.

The effectiveness of the present invention is particularly appreciated when the apparatus is part of an automated slump monitoring and control system, wherein highly concentrated chemical admixture is not sprayed primarily onto the inner drum walls but rather directly into the concrete, so that the slump changes can be made faster and with greater accuracy.

Further advantages and feature of the invention will be described in further detail hereinafter.

BRIEF DESCRIPTION OF THE DRAWINGS

Further advantages and features of the present invention may be more readily comprehended when the following detailed description of preferred embodiments is taken in conjunction with the appended drawings wherein.

DETAILED DESCRIPTION OF PREFERRED EMBODIMENTS

Figure 1:
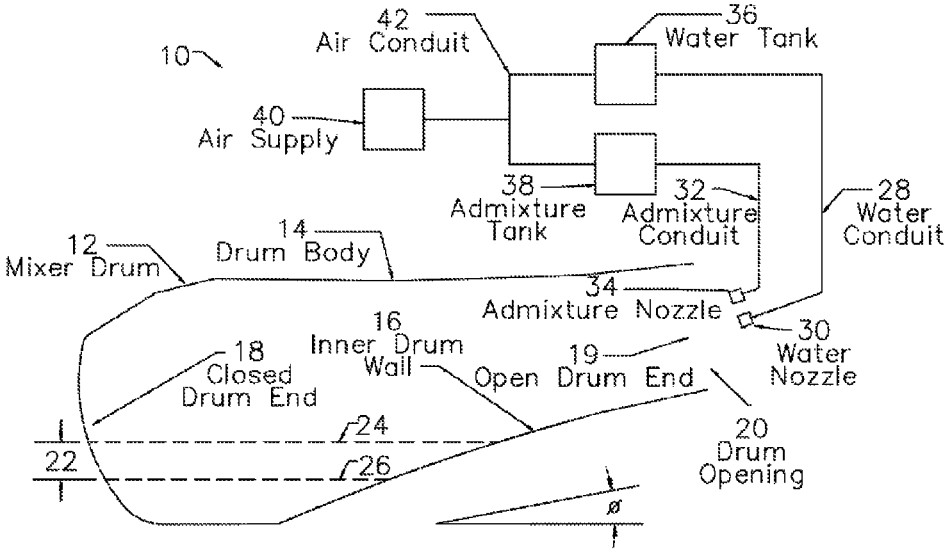
FIG. 1 is a diagrammatic illustration of an exemplary apparatus and method of the present invention for dispensing liquids into a concrete mixer drum.

The term "concrete" as used herein will be understood to refer to materials including a cement binder (e.g., Portland cement optionally with supplemental cementitious materials such as fly ash, granulated blast furnace slag, limestone, or other pozzolanic materials), water, and aggregates (e.g., sand, crushed gravel or stones, and mixtures thereof), which form a hardened building or civil engineering structure when cured. The concrete may optionally contain one or more chemical admixtures, which can include water-reducing agents, mid-range water reducing agents, high range water-reducing agents (called "superplasticizers"), viscosity modifying agents, corrosion-inhibitors, shrinkage reducing admixtures, set accelerators, set retarders, air entrainers, air detrainers, strength enhancers, pigments, colorants, fibers for plastic shrinkage control or structural reinforcement, and the like.

As mentioned in the background section, concrete delivery mixing trucks having slump control monitoring and control equipment, such as hydraulic and/or electric sensors for measuring the energy for turning the mixing drum, speed sensors for measuring the speed of rotation, temperature sensors for monitoring the atmospheric temperature as well as the mix temperature, and dispensing equipment, as well as the computer processing units (CPU) for monitoring signals from the sensors and actuating the dispensing equipment are by now relatively well known in the industry.

For example, such slump control systems, which can be used in association with wireless communication systems, are disclosed in U.S. Pat. No. 5,713,663; U.S. Pat. No. 6,484,079; U.S. Ser. No. 09/845,660 (Publication no. 2002/0015354A1); U.S. Ser. No. 10/599,130 (Publication no. 2007/0185636A1); U.S. Ser. No. 11/764,832 (Publication no. 2008/0316856); U.S. Ser. No. 11/834,002 (Publication no. 2009/0037026); and WO 2009/126138. A further exemplary system for monitoring and control using wireless communications in combination with sensors for monitoring various physical properties of the concrete mix is taught in U.S. Pat. No. 6,611,755 of Coffee. These teachings, as well as the patent references as previously discussed in the background section above, are expressly incorporated herein by reference.

Exemplary concrete mixing drums contemplated for use in the present invention include those which are customarily mounted for rotation on ready-mix delivery trucks or on stationary mixers which may be found in mixing plants. Such mixing drums have an inner circumferential wall surface upon which at least one mixing blade is attached to the inner surface so that it rotates along with the mixing drum and serves to mix the concrete mix, including the aggregates contained within the mix.

It is believed that a number of exemplary embodiments of the invention may be practiced using commercially available automated concrete mix monitoring equipment with slight modifications as would be apparent in view of the invention disclosed herein. Such mix monitoring equipment is available under the VERIFI® name from VERIFI LLC, West Chester, Ohio.

As illustrated in FIG. 1, an exemplary apparatus or system 10 of the present invention for dispensing liquids into a concrete mixing drum 12 comprises a rotatable concrete mixer drum 12 that is mounted to permit rotation about a rotation axis inclined at an orientation of 5-40 degrees relative to level ground (the angle of orientation being shown in FIG. 1 as "ø." The mixer drum 12 typically has an oblong drum body 14 with an inner circumferential wall 16 that connects a first end 18, which is closed, and a second end 19, which has an opening 20 for loading and unloading of concrete (the level of plastic concrete being designated in FIG. 1 at "(22)."

For purposes of simplifying the diagram, mixing blades are omitted from the illustrations. In concrete mixing trucks, two or more continuous mixing blades are helically arranged and mounted within the drum, such that when the mixer drum 12 is rotated in one direction, the concrete mix (designated as at 22) will be moved towards the closed end 18, and such that when the mixer drum 12 is rotated in the other direction, the concrete will be moved towards the other drum end 19 having the opening 20.

Concrete mixing drums, particularly those on mixer delivery trucks, usually have a "nominal maximum concrete capacity" whereby some space exists between the opening 20 and air/concrete interface (see 24) of the maximum rated concrete capacity. Consequently, if the mixer delivery truck drives up an incline, or is jostled when travelling over a bump or rough section of pavement, spillage of the concrete through the opening 20 is avoided or minimized.

In exemplary embodiments of the present invention, the first end 18 of the concrete mixer drum 12 is conformed to contain a nominal maximum concrete capacity, which for example could be between 2-18 cubic yards, and more preferably between 4-14 cubic yards, such that a fluid concrete (22) contained in the drum 12 in the amount of 10%-30% of said nominal maximum concrete capacity presents an air/concrete interface having a first exposed surface area, designated herein as "ESA1" (and designated in FIG. 1 as "26"); and such that a fluid concrete contained in the drum in the amount of 70%-100% of said nominal maximum concrete capacity presents an air/concrete interface having exposed surface area, designated herein as "ESA2" (and designated in FIG. 1 as "24"), whereby ESA2 is greater than ESA1.

A first conduit 28 is shown in FIG. 1 connected by a conduit 28, which could be a flexible hose or rigid pipe, to a pumped or pressurized water source 36 for introducing water into the mixer drum 12 through the opening 20. The first conduit 28 or water conduit is shown connected to an optional water nozzle 30. The water conduit 28 or nozzle 30 is aimed and mounted with respect to the drum opening 20, whereby 0%-100% of the water 36 introduced through the conduit 28 (or nozzle 30) into the drum 12 would hit the air-concrete interface within ESA2 (designated as at "24").

A nozzle 34 is shown in FIG. 1 connected by a conduit 32, which could be a flexible hose or rigid pipe, to a pumped or pressurized liquid chemical admixture source 38 for introducing liquid chemical admixture into the mixer drum 12 through the opening 20, the nozzle 34 aimed and mounted with respect to the drum opening 20 and having a nozzle aperture which is focused, whereby 75%-100% of the chemical admixture 38 sprayed through the liquid chemical admixture nozzle 34 into the mixer drum 12 would hit the air-concrete interface within ESA1 (designated as at "26").

In a preferred embodiment of the invention, an air supply 40 which could be a pressured air tank or other source of air pressure is connected using an air conduit 42 (e.g., hose or pipe) to a liquid admixture tank 38 or tanks as well as to a water tank 36, for providing pressure to drive the liquids 36/38 into the mixer drum 12 through chemical admixture nozzle 34 and/or the optional water nozzle 30 or nozzles. Alternatively, mechanical pumps (not shown) can be used to pump water from the water tank 36 into the mixer drum 12 and to pump liquid chemical admixture from the admixture tank 38 into the mixer drum 12. If the mixer apparatus 10 is located at a mixing plant, of course, the on-site water supply could be substituted for the water tank 36 and any air supply 40.

Figure 2:
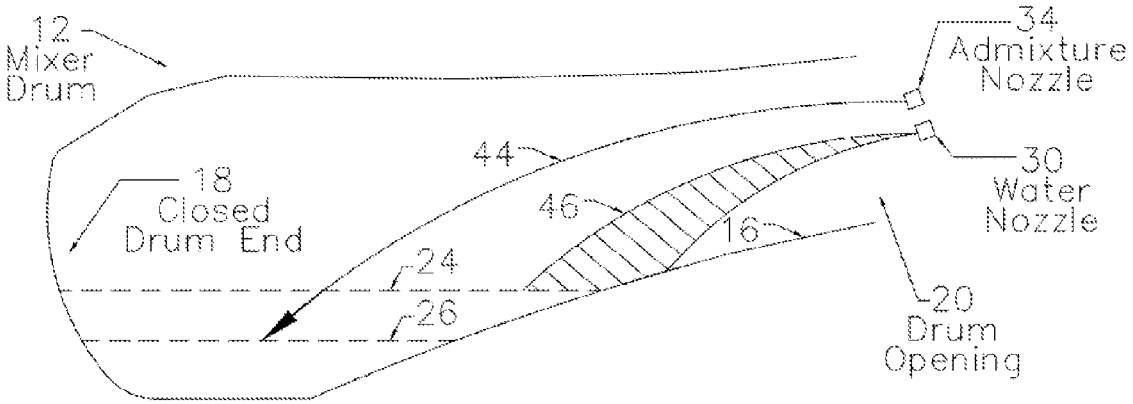
FIG. 2 is a diagrammatic illustration of exemplary dispersion patterns for each of a liquid chemical admixture and water being dispensed by the exemplary apparatus illustrated in FIG. 1.

FIG. 2 illustrates diagrammatically preferred dispersion patterns for each of a liquid chemical admixture and water being dispensed into the concrete mixer drum apparatus of FIG. 1. Preferably, nozzles 30/34 are used for dispensing both liquid chemical admixture and water into the drum 12. Accordingly, the chemical admixture nozzle 34 is shown as aimed and mounted with respect to the drum opening 20 and its nozzle 34 aperture focused such that the liquid chemical admixture sprayed 44 hits mostly the exposed surface area (ESA1) of air/concrete interface designated as at 26 and, most preferably, lands entirely within the air/concrete interface 26; whereas, the water nozzle 30 is shown as aimed and mounted with respect to the drum opening 20 and its nozzle 30 aperture focused such that water sprayed 46 hits a portion of the inner drum wall 16 and (optionally or primarily) a portion of the exposed surface area (ESA2) of air/concrete interface designated as at 24.

In other embodiments of the invention, the water nozzle 30 or two or more water nozzles can be connected to the water conduit 28 and water source 36, and can be aimed and mounted so that its spray dispersion 46 can hit any portion of the inner drum wall. For example, the aperture of the nozzle 30 or nozzles can be focused or the nozzle(s) can be aimed so that water can hit the back (closed) end 18 of the drum.

Figure 3:
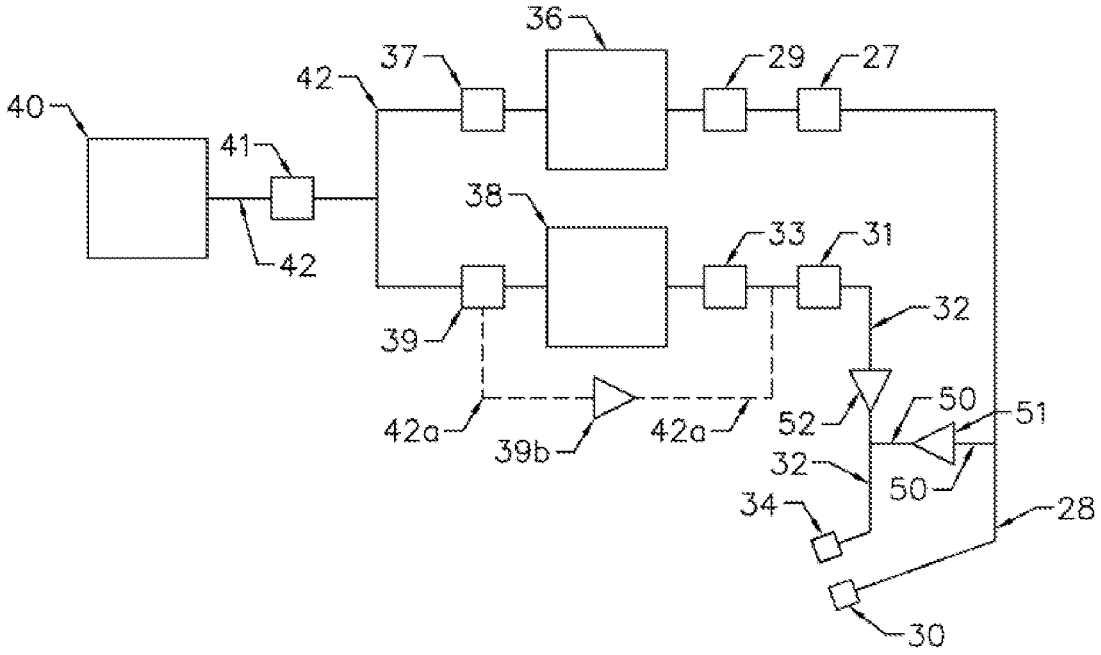
FIG. 3 is a diagrammatic illustration of another exemplary apparatus of the invention for dispensing liquids into a concrete mixer drum.

In FIG. 3, a preferred embodiment of apparatus of the invention is shown wherein a check valve assembly 50/51/52 is used to permit the chemical admixture nozzle 34 to be purged with water from the water line 28. A connecting line 50 is used to connect the admixtures conduit 32 with the water conduit 28, and a one-way check valve 51 in the connecting line 50 allows water to flow under pressure from the water conduit 28 into the admixtures conduit 28, and a second one-way check valve 52 in the admixtures conduit 32 prevents water from entering into the admixture conduit 32 and thus forces pressurized water to exit (and to purge) the admixtures nozzle 34. The present inventors believe that this is beneficial because the admixtures nozzle may tend to clog from cement dust arising during the batching operation, or from concrete as it is sloshed around in the mixing drum.

Thus, in preferred systems and methods of the invention, water is sent simultaneously through the admixtures nozzle 34 as well as through the water nozzle 30 or nozzles, using the check valve assembly 50/51/52 described above. Hence, the liquid chemical admixture nozzle 34 is connected by a back check valve assembly 50/51/52 to said water conduit 28 to permit the liquid chemical admixture nozzle 34 to be purged with water, the back check valve assembly comprising: a connecting line 50 for connecting the water conduit 28 to the admixture nozzle 34; a first back check valve 51 within the connecting line 50 for permitting water to flow from the water conduit 28 to the admixture nozzle 34 and to prevent liquid chemical admixture 38 from flowing into the water conduit 28; and a second back check valve 52 to prevent water 28 from flowing towards the liquid chemical admixtures source 38.

Accordingly, the present invention provides methods for dispensing liquids into concrete mixer drums, comprising introducing chemical admixture and water into concrete within the mixer drum through separate nozzles, and, where water is introduced into the concrete, the water is introduced through both the chemical admixture nozzle and at least one separate water nozzle, whereby the nozzles are connected conduits connected by the back check valve assembly 50/51/52 and described hereinabove.

FIG. 3 also illustrates a preferred embodiment of the apparatus for use in combination with automated slump monitoring systems, such as are available under the "VERIFI" brand from VERIFI LLC, West Chester, Ohio. Such slump monitoring systems are designed to monitor and to record the amounts of water and/or chemical admixture introduced into the mixer drum. In the embodiment illustrated in FIG. 3, a valve 33 ("admixtures valve") and meter 31 ("admixtures meter") are used in the admixtures conduit 32 for forcing liquid chemical admixture through the admixture line back check valve 52 and into the admixtures nozzle 34. Similarly, valve 27 ("water valve") and meter 29 ("water meter") are used in the water conduit 28 for forcing water through the water nozzle 30 as well as through the connector line 50 and connector line back check valve 51 to purge the admixtures nozzle 34. The admixtures valve 33, admixtures meter 31, water valve 27, and water meter 29 are electrically or electronically connected to a CPU of the slump monitoring system which controls and/or monitors these devices.

Further exemplary systems and methods of the invention further comprise a water meter 29 and water valve 27 for controlling and monitoring the amount of water introduced into the concrete mixer drum 12; and further comprising a liquid chemical admixture meter 31 and admixture valve 33 for controlling and monitoring the amount of liquid chemical admixture into the concrete mixer drum 12. This is particularly effective when used in combination with the aforementioned back check valve assembly 50/51/52 illustrated in FIG.

3 and explained above. Preferred exemplary systems and methods thus comprise the use of a computer processing unit (CPU) in combination with a hydraulic sensor for measuring the hydraulic pressure required to rotate the concrete mixer drum, a speed sensor for measuring the speed of mixer drum rotation, and preferably both of these sensors, with the system automatically adjusting a rheology property of the concrete (e.g., slump, slump flow, resistance to flow, thixotropy, or other rheology property), by introducing a liquid chemical admixture 38 and/or water 36 through the above-described apparatus 10 as previously described and illustrated and as further described and illustrated hereinafter.

FIG. 3 also shows optional connection of the water conduit 28 to a valve 49 and hose nozzle 48. This would be used for washing tools, the delivery chute, or outside of the truck.

FIG. 3 also shows an exemplary air valve 41 located in the air conduit 42 which connects the air source 40 to the water tank 36 and admixtures tank 38. This valve 41 allows the air pressure to be decreased so that either or both of the tanks 36/38 can be swapped out. In this regard, an exhaust valve 37 can also be used in the air line connecting the water tank 36, and an exhaust valve 39 can also be used in the air line connecting the admixtures tank 38, so as to control the amount of air pressure within the respective tanks 36/38, and also to bleed the pressure within the respective tanks 36/38 to facilitate replacement operations.

In a further exemplary embodiment of the invention, an additional air line (designated as at 42*a*) may be used to connect the admixture tank exhaust valve 39 to the admixture conduit 32 so that pressurized air can be used to purge the admixture conduit 32 and admixture nozzle 34. A one-way check valve 39B is used in the line 42*a* to prevent admixture from entering line 42*a*. Thus, in further exemplary systems and methods of the invention, the admixture valve 34 and admixture conduit 32 can be purged with air as explained above.

In further exemplary embodiments of the invention, both an admixture nozzle 34 and at least one water nozzle 30 are employed, each having a spray aperture (diameter) which is smaller than the inner diameter of the respective conduit (32/28) which feeds liquid to the respective nozzles 34/30. In other words, the admixture nozzle 34 aperture will have a smaller diameter than the admixture conduit 32, while the water nozzle 30 or nozzles will have a smaller diameter than the water conduit 28. In still further exemplary embodiments, the admixture nozzle 34 aperture or apertures will have combined cross-sectional area that is smaller than the combined cross sectional area of the water nozzle 30 aperture or apertures.

Exemplary admixture nozzles 34 as well as water nozzles 30 can be made of plastic (e.g., nylon, PVC, etc.) or metal (e.g., brass) and can be aimed and mounted with respect to the drum opening using any known means. The nozzles may have coatings of silicone or other low-friction material to enhance ease of cleaning. With respect to aiming and mounting with respect to the drum opening, metal nozzles can be welded into position onto brackets or hopper located outside of the concrete mixing drum, although this is not preferred, because nozzles are often bent out of position by the force of aggregates loaded into the drum, and hence would be difficult to adjust. More preferably, the admixture nozzle 34 and water nozzle(s) 30 are aimed and mounted in place using adjustable brackets and clamps which permit the nozzles to be adjusted along x, y, and z planes, so that the nozzles can be installed and adjusted without substantial inconvenience.

As summarized previously, an exemplary method of the invention involves providing the above-mentioned apparatus 10 on a concrete mixer drum, and particularly on a concrete mix truck. In preferred embodiments, the liquid chemical admixture nozzle 34 is connected to the check valve assembly 50/51/52 (illustrated in FIG. 3 and previously explained above) so that the admixture nozzle 34 can be purged whenever water is injected through the water conduit 28 or water nozzle 30. Alternatively, the liquid chemical admixture nozzle 34 can be connected to an air line (as shown at 42*a* in FIG. 3) so that it can be purged with air.

Figure 4A:
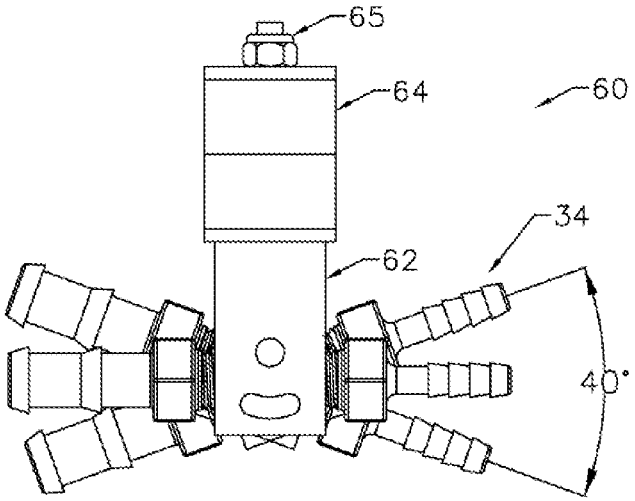
FIGS. 4A and 4B are illustrations of a side and longitudinal view, respectively, of an exemplary nozzle of the invention.
Figure 4B:
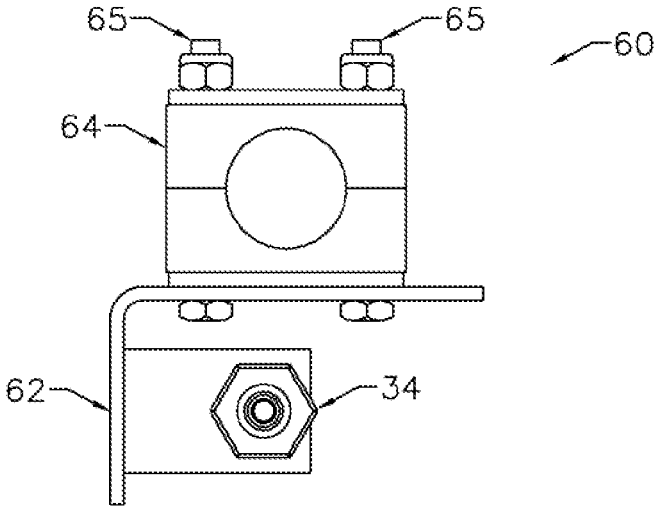

FIG. 4A illustrates a side view of an exemplary nozzle assembly 60 while FIG. 4B illustrates a longitudinal view of the exemplary nozzle assembly 60. The nozzle 34 can be made from conventional components, such as pressure-couplings which can be used to join hoses without the need for fasteners or adhesives. The nozzle is shown swivably mounted on a holding bracket device 62 that is connected to a pipe or hose bracket 64. Bolts 65 are used to hold the assembly 60 together.

Thus, for example, the nozzle assembly 60 shown in FIGS. 4A and 4B can be used as the liquid chemical admixture nozzle 34 which can be clamped, using the bracket 64, to a water pipe or hose at the drum opening 20. In another embodiment, two holding bracket devices 62 can be used on either side of the screw-held bracket device 64, such that both liquid chemical admixture nozzle and water nozzle can be mounted onto a structure or pipe at the drum opening.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Skilled artisans can make variations and changes without departing from the spirit of the invention.

It is claimed:

1. An apparatus for injecting liquids into a rotatable concrete mixer drum, comprising:

a concrete mixer drum which is rotatably mounted to permit rotation about a rotation axis inclined at an orientation of 5-40 degrees relative to level ground and which has an oblong drum body with a inner circumferential wall connecting opposed first and second ends for defining a cavity within which to contain a fluid concrete;

one of said two opposed ends of said oblong drum body having an opening to permit loading and unloading of concrete, and the other end being conformed to contain a nominal maximum concrete capacity such that a fluid concrete contained in the drum in the amount of 10%-30% of said nominal maximum concrete capacity presents an air/concrete interface having a first exposed surface area, designated herein as "ESA1," and such that a fluid concrete contained in the drum in the amount of 70%-100% of said nominal maximum concrete capacity presents an air/concrete interface having exposed surface area, designated herein as "ESA2," whereby ESA2 is greater than ESA1;

a first conduit connected to a water source for introducing water into said mixer drum through said opening, said first conduit being aimed and mounted with respect to said drum opening, whereby 0%-100% of the water introduced through said first conduit into the drum would hit the air-concrete interface within ESA2; and a nozzle connected to a liquid chemical admixture source for introducing liquid chemical admixture into said drum through said opening, said nozzle being aimed and mounted with respect to said drum opening and having a nozzle aperture which is focused, whereby 75%-100% of the chemical admixture sprayed through said liquid chemical admixture nozzle into the drum would hit the air-concrete interface within ESA1.

2. The apparatus of claim 1 wherein said chemical admixture nozzle is further connected to a pumped or pressurized water source as well as to a liquid chemical admixture source, said apparatus further comprising a check valve to allow water to be used to purge said chemical admixture nozzle aperture.

3. The apparatus of claim 1 wherein said first conduit connected to a water source for introducing water into said mixer drum has a nozzle having an aperture to permit water sprayed through nozzle to be focused.

4. The apparatus of claim 1 wherein said nozzle connected to a liquid chemical admixture source for introducing liquid chemical admixture into said drum is aimed and focused such that 100% of the chemical admixture sprayed into the drum would hit the air-concrete interface within ESA1.

5. The apparatus of claim 1 wherein said concrete mix drum is rotatably mounted on a concrete delivery truck, and said chemical admixture source is also mounted on said truck.

6. The apparatus of claim 1 wherein said nozzle connected to a liquid chemical admixture source for introducing liquid chemical admixture into said drum (hereinafter "admixture nozzle") is connected by a back check valve assembly to said first conduit connected to a water source for introducing water into said mixer drum (hereinafter "water conduit") to permit said admixture nozzle to be purged with water, said back check valve assembly comprising:

a connecting line for connecting said water conduit to said admixture nozzle;

a first back check valve within said connecting line for permitting water to flow from said water conduit to said admixture nozzle but to prevent liquid chemical admixture from flowing into said water conduit; and a second back check valve to prevent water from flowing towards said liquid chemical admixture source.

7. The apparatus of claim 1 further comprising a water meter and water valve for controlling and monitoring the amount of water introduced into the concrete mixer drum, and further comprising a liquid chemical admixture meter and admixture valve for controlling and monitoring the amount of liquid chemical admixture into the concrete mixer drum.

* * * * *